US005476535A

United States Patent [19]

Khasin

[11] Patent Number: 5,476,535

[45] Date of Patent: Dec. 19, 1995

[54] METHOD OF PRODUCING HIGH-PURITY ULTRA-FINE METAL POWDER

[75] Inventor: Ernst Khasin, Rishon LeZion, Israel

[73] Assignee: Ultrafine Technologies Ltd., Beersheva, Israel

[21] Appl. No.: 298,761

[22] Filed: Aug. 31, 1994

[30] Foreign Application Priority Data

Sep. 9, 1993 [IL] Israel ..... 106958

[51] Int. Cl.[6] ..... B22F 9/16; B22F 9/20

[52] U.S. Cl. ..... 75/345; 75/744; 216/56; 216/102; 216/103

[58] Field of Search ..... 75/343, 345, 744; 134/1, 2, 3, 28, 29; 216/102, 103, 56

[56] References Cited

U.S. PATENT DOCUMENTS

| | | | |
|---|---|---|---|
| 2,752,237 | 6/1956 | Short . | |
| 2,931,713 | 4/1960 | Newhard et al. | 216/102 |
| 2,997,245 | 8/1961 | Nilsson et al. | 75/345 |
| 3,190,748 | 6/1965 | Landgraf . | |
| 3,369,886 | 2/1968 | Metzger et al. . | |
| 3,725,035 | 4/1973 | Short et al. . | |
| 3,820,979 | 6/1974 | Manassen . | |
| 3,839,012 | 10/1974 | Roberts | 75/345 |
| 4,039,317 | 8/1977 | Montino et al. . | |
| 4,101,311 | 7/1978 | Aonuma et al. . | |
| 4,274,877 | 6/1981 | Collier et al. . | |
| 4,359,344 | 11/1982 | Skach, Jr. | 134/2 |
| 4,370,361 | 1/1983 | Gray | 216/102 |
| 4,407,674 | 10/1983 | Ehrreich . | |
| 4,456,473 | 6/1984 | Jost . | |
| 4,518,457 | 5/1985 | Gray | 216/102 |
| 4,748,737 | 6/1988 | Charles et al. . | |
| 4,784,686 | 11/1988 | Meek et al. . | |
| 4,824,482 | 4/1989 | Baldi . | |
| 4,888,086 | 12/1989 | Hossack et al. | 216/102 |
| 4,979,985 | 12/1990 | Tosun et al. . | |
| 5,013,346 | 5/1991 | Masumoto et al. . | |
| 5,049,233 | 9/1991 | Davis | 216/102 |
| 5,188,660 | 2/1993 | Tosun et al. . | |
| 5,250,101 | 10/1993 | Hidaka et al. . | |

FOREIGN PATENT DOCUMENTS

| | | |
|---|---|---|
| 267079 | 7/1970 | U.S.S.R. . |
| 784986 | 12/1980 | U.S.S.R. . |

*Primary Examiner*—David A. Simmons
*Assistant Examiner*—Margery S. Phipps
*Attorney, Agent, or Firm*—Ladas & Parry

[57] ABSTRACT

A method of producing a high-purity, ultra-fine powder of a first metal, particularly silver, by forming an alloy of the first metal with a second metal, such as aluminum subjecting the alloy to a leaching agent effective to leach out the second metal, leaving a porous first metal agglomerate; mixing the porous first metal agglomerate with a fresh batch of leaching agent; disintegrating the agglomerate and applying ultrasonic oscillations to the mixture to enhance the penetration of the leaching agent into the pores of the agglomerate; removing the leaching agent, leaving the first metal; and washing and drying the first metal.

20 Claims, No Drawings

METHOD OF PRODUCING HIGH-PURITY ULTRA-FINE METAL POWDER

FIELD AND BACKGROUND OF THE INVENTION

The present invention relates to a method of producing metal powders, and particularly to a method of producing high-purity, ultra-fine metal powders. The invention is particularly applicable for producing silver powders of high-purity and ultra-finess, and therefore is described below with respect to this particular application.

There are many users for silver powders, including electronic processes, batteries, conductive coatings and shielding materials, conductive inks, water purification, catalyst manufacture and dental amalgams. Silver powders may be produced by most of the method currently used to manufacture metal powders in general, including chemical precipitation, physical atmoziation or milling, thermal decomposition and electrochemical deposition. However, many applications require silver powder in ultra-fine form, i.e., with an average particle size less than 150 nm. These latter applications include use: as a catalyst in the oxygen electrodes of fuel cells; in high-performance positive electrodes of Ag-Zn, Ag-$H_2$ and Ag-Cd batteries; and in low-temperature heat exchangers, conductive glues and films, conductive and semi-conductive polymers, adjustable resistors, and dispersion-strengthened materials.

My USSR Inventor's Certificate No.267079 published Jul. 16, 1970, discloses a method of producing ultra-fine silver powder based on the "Raney" method of making a "skeleton" catalyst, but avoiding the labor-consuming and environmental-dangerous crushing and nulling operations. The method therein disclosed involves the following procedure: form a silver-aluminum alloy having a silver content of up to 50% by weight; roll the alloy into foil strips having a thickness of 0.5–5 mm; surface-clean the foil strips, in order to remove aluminum oxide and other impurities; heat-treat the foil strips at 550° C. in a protective atmosphere (e.g., argon), and maintain this temperature for about 1.5 hours in order to form a homogenized supersaturated solid solution of silver in aluminum, followed by quenching in water to fix the structure; leach out the aluminum from the alloy in a 20–40% solution of KOH or NaOH at a temperature of 0–80° C.; wash-out the powder; and dry the powder.

The above method results in a very porous silver agglomerate (porosity of approximately 85%) consisting of particles having an average size of 30–150 nm (0.03–0.15 microns), a spheroidal shape, and a crystal face on the surface. These agglomerates are very weak, and their cohesive strength between particles is extremely low, enabling the agglomerates to be easily crushed by milling to form very fine particles.

While the technique described in the above publication produced ultra-fine silver particles, this technique has been found to have two drawbacks: The amount of residual aluminum in the silver powder made by this technique is relatively high, being about 0.5–1%; and the heat-treatment operation, to be performed in a protective (e.g., argon) atmosphere, is very complicated and costly.

OBJECTS, SUMMARY AND ADVANTAGES OF THE INVENTION

An object of the present invention is to provide a method of producing metal powder, particularly silver powder, having a significantly higher degree of purity than that obtainable by the above-described technique. Another object is to provide such a method requiring a simpler and less expensive heat treatment operation.

According to the present invention, there is provided a method of producing high-purity, powder of a first metal, comprising: forming an alloy of the first metal with a second metal; subjecting the alloy to a leaching agent effective to leach out the second metal, leaving a porous first metal agglomerate; mixing the porous first metal agglomerate with a fresh batch of leaching agent; disintegrating the agglomerate in the mixture and applying ultrasonic oscillations to the mixture to enhance the penetration of the leaching agent into the pores of the agglomerate; removing the leaching agent, leaving the first metal; and washing and drying the first metal.

According to a further feature, the alloy is rolled into thin strips and is then heat treated to form a homogeneous phase from which the second metal can be removed by the leaching agent.

The invention is particularly useful for producing high-purity, ultra-fine silver powder wherein the phase formed by the heat-treating step is a supersaturated solid solution of silver in aluminum.

The thorough stirring may be done by using conventional heavy-duty stirrers. The ultrasonic oscillations may be produced according to various known techniques, e.g., utilizing electromagnetic, magnetostrictive, or piezoelectric transducers. The transducers may be mounted internally, for example at the sides of the treatment tank, or externally of the tank, or the treatment tank may be enclosed in a second container holding the transducer and filled with an intermediate liquid.

Preferably, the ultrasonic oscillations are at a frequency of 15–300 KHz; in the example described below, the frequency is 40 KHz. Also, the ultrasonic oscillations are preferably applied for a period of 10–60 minutes, the period being 25 minutes in the example described below. The leaching agent in both leaching operations (stirring and ultrasonic) is preferably an alkaline solution providing an excess of hydroxyl ions, the leaching agent in both leaching steps is a 20–45%, preferably a 35%, solution of KOH or NaOH in the example described below.

It has been found that this novel technique significantly reduces the residual aluminum in the silver powder thereby significantly increasing its purity. Thus, whereas the technique described in the above publication resulted in residual aluminum in the silver powder of about 0.5–1%, the amount of residual aluminum remaining in the silver powder produced according to the novel technique briefly described above was substantially less than 0.2%.

According to another feature of the present invention, the heat-treating step is performed in an air atmosphere and is followed by a surface-cleaning step, which can be done mechanically or chemically. For example, the alloy may be immersed in a 10–15% solution of KOH or NaOH, rinsed, immersed in a 30–40% solution of $HNO_3$, and rinsed again. Performing the heat treating step in an air atmosphere, rather than in a controlled (e.g., argon) atmosphere, substantially simplifies and lowers the cost of the treatment operation. This advantage is obtained because the surface-cleaning operation is performed after the heat-treatment, rather than before as in the above-described technique, so that any surface oxidation or impurities produced during the melting, rolling and heat treatment operation, even in an air atmosphere, as removed by the subsequent surface-cleaning operation.

POSSIBLE MECHANISM OF ACTION

As indicated above, an important advantage of the novel technique is the substantial increase in the purity of the metal (e.g., silver) powder produced. Following is one possible explanation how this result is obtained in the method of the present invention particularly when applied to producing pure silver powders.

The amount of residual aluminum in the produced silver powder is determined by the completeness of aluminum removal during the leaching operation. It is believed that the leaching operation involves two steps:

1. The reaction of aluminum with water, as follows:

$$2Al+6H_2O \rightarrow 2Al(OH)_3+3H_2\uparrow \quad (1)$$

The reaction of the aluminum hydroxide produced in step 1 with an excess of hydroxyl ions, is as follows:

$$Al(OH)_3+KOH \rightarrow K[Al(OH)_4] \quad (2)$$

The overall reaction may thus be expressed as follows:

$$2Al+2KOH+6H_2O \rightarrow 2K[Al(OH)_4]+3H_2\uparrow \quad (3)$$

The above reaction requires a large excess of hydroxyl ions. If there is a deficiency, or even an approximate equivalency, of the base, the neutral "hydroxide" produced (which is actually a conglomeration of hydrated aluminum ions, water molecules, and hydroxyl ions in the form of large an indefinite molecule) is precipitated as a white gel.

The leaching operation in the previously-known technique forms agglomerates of silver powder having a very fine porous structure. This structure, and the produce hydrogen released during the reaction (Equation 1 above), appears to limit the excess hydroxyl ions delivered in the reaction zone. This apparently results in precipitation of the "hydroxide" in the fine pores of the agglomerates, which blocks the pores. As a result, some aluminum does not react with the alkaline solution and remains in the powder in the form of the supersaturated solid solution.

It therefore appears that the precipitated hydroxide and unleached aluminum in the supersaturated solid solution are the two main factors causing a relatively high amount of residual aluminum to remain in the produced silver powder.

This relatively high amount of residual aluminum is substantially reduced in the above-described method of the present invention, wherein, after the leaching operation, the resultant porous silver agglomerate is mixed with a fresh batch of aluminum leaching agent and is subjected to thorough stirring and ultrasonic oscillations at a frequency of 15–300 KHz, preferably about 40 KHz. The fresh batch of leaching agent, together with the stirring followed by ultrasonic oscillation, assures that there will be a large excess of hydroxyl ions for the above reaction, and that these hydroxyl ions will penetrate more thoroughly into the pores of the agglomerate of silver powder produced following the initial leaching step. The stirring is such as to disintegrate, i.e., to crush and pulverize, the agglomerate thereby increasing the surface area of the solid particles exposed to the leaching agent during the application of the ultrasonic oscillations, further enhancing the penetration of the leaching agent. As a result, this treatment significantly decreases the amount of aluminum which does not react with the alkaline solution, producing silver powder of much higher purity than the previously known method.

The amount of residual aluminum could also be reduced by increasing the temperature of the leaching operations up to 60°–80° C., but in this case, the final powder will be much coarser, with much higher aggolomerate strength.

DESCRIPTION OF A PREFERRED EMBODIMENT

Following is an example of a method for producing high-purity, ultra-fine silver powder according to the present invention:

0.5 Kg of Ag-Al alloy (40% Ag) was made from 0.2 Kg Ag (purity 99.99) and 0.3 Kg Al (purity 99.99) in a graphite crucible in an induction furnace. The alloy was poured into a cast iron mould, to produce an ingot of a size of 60×20×1.07 mm. The ingot was then rolled in a duo rolling mill to produce film strips of a thickness 2.0 mm. The strips were then heated in an air batch-type furnace to 550° C., maintained at this temperature for two hours and quenched in water. The chemical surface cleaning of the strips was then carried out by immersing them in a 15%-solution of KOH, then in water, then in a 30% solution of $HNO_3$, and finally water again.

The leaching was carried out in 4 liters 25% KOH at 30° C. for a period of 12 hours. A special bath made from stainless steel with water cooled walls was used for this operation.

After the leaching was finished, 0.2 Kg of agglomerates of the silver powder formed as a result of the leaching operation was transferred into a smaller tank made from stainless steel and flooded with 0.75 liters fresh 35% KOH. The stirring was by a Kitchen Aid stirrer, Model K-5SS (325W), at a speed of the second position (about 25 RPM), for a time of 15 minutes. Ultrasonic oscillations at a frequency of 40 KHz were applied to the tank. The ultrasonic bath used was "Camlas" model Transonic T460/h, with a power output of 285 watts, and water was used as the intermediate liquid in the bath. The time of ultrasonic treatment was 25 mins. Following the ultrasonic treatment, the resulting powder was washed out and dried.

Chemical analysis showed the aluminum content of the powder to be as follows:

1. After the leaching operation—0.68%
2. After the additional ultrasonic treatment operation'0.13%

Following are the main properties of the powder resulting from the above-described method:

Specific surface area: 7 $m_2$ gram

Average particle size: 85 nm

Silver content: greater than 99.85%

Apparent density: 2.1 g $cm^{-3}$

While the invention has been described with respect to one preferred example, it will be appreciated that many variations, modifications, and applications of the invention may be made.

I claim:

1. A method of producing a high-purity, ultra-fine powder of a first metal, comprising:

forming an alloy of said first metal with a second metal;

subjecting the alloy to a leaching agent effective to leach out said second metal, leaving a porous first metal agglomerate;

mixing the porous first metal agglomerate with a fresh batch of leaching agent to form a mixture;

disintegrating the agglomerate in the mixture and applying ultrasonic oscillations to the mixture to enhance the penetration of the leaching agent into the pores of the agglomerate;

removing the leaching agent, leaving said first metal; and washing and drying said first metal.

2. The method according to claim 1, wherein the alloy of the first metal and second metal is rolled into thin strips and is heat treated to form a homogeneous phase from which the second metal can be removed by the leaching agent.

3. The method according to claim 1, wherein said first metal is silver, and said second metal is aluminum.

4. The method according to claim 3, wherein the silver is present up to 50% by weight in the alloy, and wherein the alloy strips are heat treated to form a supersaturated solid solution of silver in aluminum before the leaching step.

5. The method according to claim 1, wherein said ultrasonic oscillations are at a frequency of 15–300 KHz.

6. The method according to claim 5, wherein said ultrasonic oscillations are at a frequency of approximately 40 KHz.

7. The method according to claim 1, wherein said ultrasonic oscillations are applied for a period of 10–60 minutes.

8. The method according to claim 7, wherein said ultrasonic oscillations are applied for a period of approximately 25 minutes.

9. The method according to claim 1, wherein said leaching agent in both leaching operations is an alkaline solution providing an excess of hydroxyl ions.

10. The method according to claim 9, wherein said leaching agent in both leaching steps is a 20–45% solution of KOH or NaOH.

11. The method according to claim 1, wherein the alloy is rolled to a strip thickness of 0.5–5 mm before being subject to the leaching agent.

12. A method of producing high-purity, ultra-fine silver powder, comprising:

rolling an alloy of silver and aluminum, having a silver content of up to 50% by weight, into thin strips;

heat-treating the strips to form a homogeneous supersaturated solid solution alloy of silver in aluminum;

subjecting the supersaturated solid solution alloy to an aluminum-leaching agent, effective to leach out aluminum, leaving a porous, silver agglomerate;

mixing the porous silver agglomerate with a fresh batch of aluminum-leaching agent to form a mixture;

thoroughly stirring and applying ultrasonic oscillations to the mixture;

removing the leaching agent leaving silver; and washing and drying said silver.

13. The method according to claim 12, wherein the heat treating step is performed in an air atmosphere and is followed by a surface-cleaning step.

14. The method according to claim 13, wherein the surface-cleaning step includes immersing the super-saturated solid solution alloy in a 10–15% solution of KOH or NaOH, rinsing same, immersing it in a 30–40% solution of $HNO_3$ and rinsing same.

15. A method of producing a high purity, porous silver agglomerate particularly useful for producing a high-purity, ultra-fine silver powder, comprising:

rolling an alloy of silver and aluminum, having a silver content of up to 50% by weight, into thin strip;

heat-treating the strips in an air atmosphere to form a supersaturated solid solution of silver in aluminum;

surface-cleaning the produced supersaturated alloy; and subjecting the surface-cleaned supersaturated alloy to an aluminum leaching agent effective to leach out aluminum, leaving a porous silver agglomerate.

16. The method according to claim 15, wherein the surface-cleaning step includes immersing the super-saturated alloy in a 10–15% solution of KOH or NaOH, rinsing same, immersing it in a 30–40% solution of $HNO_3$, and again rinsing same.

17. The method according to claim 15, wherein the porous silver agglomerate resulting from the leaching out of the aluminum is mixed with a fresh aluminum-leaching agent to form a mixture, the mixture is then subjected to thorough stirring and ultrasonic oscillations to enhance the penetration of the leaching agent into the agglomerate, the leaching agent is removed leaving high-purity silver, and the resulting silver is washed and dried.

18. The method according to claim 17, wherein said ultrasonic oscillations are at a frequency of 15–300 KHz.

19. The method according to claim 17, wherein said leaching agent in both leaching operations is an alkaline solution providing an excess of hydroxyl ions.

20. The method according to claim 17, wherein the silver-aluminum alloy is rolled to a strip thickness of 0.5–5 mm.

* * * * *